US010556164B2

(12) United States Patent
Donley

(10) Patent No.: US 10,556,164 B2
(45) Date of Patent: Feb. 11, 2020

(54) COLLAPSIBLE SPORTS GOAL

(71) Applicant: Tim Donley, Roanoke Rapids, NC (US)

(72) Inventor: Tim Donley, Roanoke Rapids, NC (US)

( * ) Notice: Subject to any disclaimer, the term of this patent is extended or adjusted under 35 U.S.C. 154(b) by 0 days.

(21) Appl. No.: 15/443,701

(22) Filed: Feb. 27, 2017

(65) Prior Publication Data

US 2017/0246522 A1 Aug. 31, 2017

Related U.S. Application Data

(60) Provisional application No. 62/301,153, filed on Feb. 29, 2016.

(51) Int. Cl.
*A63B 63/00* (2006.01)

(52) U.S. Cl.
CPC ..... *A63B 63/004* (2013.01); *A63B 2210/52* (2013.01)

(58) Field of Classification Search
CPC ..... A63B 63/004; A63B 2210/52
USPC ..... 473/478; 273/400, 407
See application file for complete search history.

(56) References Cited

U.S. PATENT DOCUMENTS 4,258,923 A * 3/1981 Senoh ..... A63B 63/004 473/478
4,420,158 A * 12/1983 Klock ..... A63B 63/004 248/156
4,702,478 A * 10/1987 Kruse ..... A63B 63/004 135/123
5,080,375 A * 1/1992 Moosavi ..... A63B 63/004 473/478
5,308,083 A * 5/1994 Grunfeld ..... A63B 63/004 273/396
5,346,227 A * 9/1994 Amram ..... A63B 63/004 273/400
5,566,952 A * 10/1996 Mullin ..... A63B 63/004 273/400
5,655,774 A * 8/1997 Cox ..... A63B 63/004 273/400
5,695,195 A * 12/1997 John ..... A63B 63/004 273/400
5,709,428 A * 1/1998 Hugghins ..... A47C 4/283 135/127
5,842,939 A * 12/1998 Pui ..... A63B 63/004 273/400
5,857,928 A * 1/1999 Stewart ..... A63B 63/004 273/400
5,954,600 A * 9/1999 Gill ..... A63B 63/004 273/400
6,000,175 A * 12/1999 Gale ..... E04H 15/58 135/122

(Continued)

*Primary Examiner* — Joseph B Baldori
(74) *Attorney, Agent, or Firm* — Jacob M. Ward; Ward Law Office LLC

(57) ABSTRACT

A foldable, portable sports goal structure includes a hollow frame that contains an elastic cord or cable that uses compressive forces from the cord tension to hold the frame together. The sports goal includes ground support bars, sidebars and a crossbar. Rear support bars may also be used. The elastic cord or cable that is under tensions is used to hold the frame together when the goal is set up. The elastic cord or cable also holds the frame together when the goal is folded up so the goal can be quickly set up or folded up. The net can remain attached to the frame, which allows the goal to be used or stored as a single unit.

3 Claims, 3 Drawing Sheets

(56) References Cited

U.S. PATENT DOCUMENTS

| | | | | |
|---|---|---|---|---|
| 6,209,878 | B1 | 4/2001 | Munro | |
| 6,716,123 | B1 * | 4/2004 | Chen | A63B 61/00 473/490 |
| 6,846,253 | B1 * | 1/2005 | Szwalek | A63B 63/004 473/422 |
| 6,979,274 | B1 * | 12/2005 | Raber | A63B 63/004 473/471 |
| 7,775,916 | B1 * | 8/2010 | Mahoney | A63B 63/004 403/292 |
| 8,216,093 | B2 * | 7/2012 | Chen | A63B 61/02 473/490 |
| 8,292,300 | B2 * | 10/2012 | Moore, III | A63B 63/004 273/400 |
| 2003/0153412 | A1 * | 8/2003 | Duba | A63B 63/004 473/478 |
| 2003/0224866 | A1 * | 12/2003 | Chen | A63B 61/003 473/197 |
| 2016/0339314 | A1 * | 11/2016 | Parsons | A63B 63/004 |

* cited by examiner

COLLAPSIBLE SPORTS GOAL

CROSS REFERENCE TO RELATED APPLICATIONS

This application claims the benefit of U.S. Provisional Patent Application Ser. No. 62/301,153, filed on Feb. 29, 2016. The entire disclosure of the above application is hereby incorporated herein by reference.

FIELD

The present disclosure relates to a collapsible sports goal and, more specifically, a goal support system reinforced using elastic cords.

BACKGROUND

The U.S. Department of Health and Human Services has reported that sports participation records in the United States have reached record levels in recent years. Sports can positively impact both children and adults, providing opportunities to exercise and spend time with peers in a healthy environment.

Proficiency in a sport requires patience and, more importantly, practice. Practice allows a person to hone their skills and improve as a player. To increase the benefits of practice, simulations around the goal area are often desired. Practicing around a goal area sharpens goal-tending skills and goal-scoring ability, A known issue with practicing is the lack of available goals on school campuses and in parks. Thus, there is a need for a transportable goal that allows players to simulate a goal area during practice.

In U.S. Pat. No. 6,209,878 to Munro, a collapsible, portable sporting goal frame is provided, having a pair of side support frames connected by a pair of flexible cables. Each of the side frames is constructed of a sequence of individual tubular frame members that connect to one another on an end-to-end basis. An elastic cord runs through each of the tubular members, and is placed in a stretched configuration when the tubular members are slideably connected together, end-to-end. The elastic cord thereby applies a compressive force against the connected frame members, resisting the unintentional disassembly thereof. When storage or transport is required, the individual members slide apart, with the elastic cord maintaining sequential order of the frame members. The net is attached to the flexible cables and the tubular frame members collapse in a manner forming a take-up spindle for the netting.

There is a continuing need for a portable framework structure that may be used in combination with a net to construct a sports goal for use in various sporting events.

SUMMARY

In concordance with the instant disclosure, a portable framework structure that may be used in combination with a net to construct a sports goal for use in various sporting events, has been surprisingly discovered.

The present disclosure relates to portable framework structures and, more particularly, to such structures as are used in combination with a net to construct a sports goal for use in various sporting events. More specifically, the present disclosure relates to a portable goal that will easily fold and is constructed of interconnecting components held together by the compressive forces of stretched elastic cord or cable.

It is an object of the disclosure to provide a totally collapsible sports goal which can be folded down into one compact unit that is not more than four feet long which allows it to be easily carried around, easily transported in a car trunk, easily shipped from place to place and easily stored.

It is a further object of the disclosure to provide an improved collapsible and portable spots goal which is lightweight in construction, but yet strong, stable and easy to erect.

The sports goal can be fabricated from various materials, such as wood, plastic or metal.

In one embodiment, a sports goal includes a goal frame having a plurality of hollow separable support segments configured to be assembled to form the frame. The separable support segments including a first separable support segment and a second separable support segment. The first separable support segment is disposed adjacent to the second separable support segment. An end of the first separable support segment is configured to selectively connect with second separable support segment. An elongated elastic cord is under tension where the goal frame assembled, and facilitates a securing of separable supports segments to one another where the separable supports are assembled to form the frame.

In another embodiment, the sports goal includes a plurality of hollow separable segments, connected by friction fit joints or couplers, which connect to form a structure including a ground support bar connected to two sidebars, which together support a top crossbar. The two sidebars along with the top crossbar represent the goal face or goal opening. The size of the sidebars and the crossbar determine the dimensions of the goal opening. The ground support bar connects to the sidebars and lies on the ground to hold up the goal face, thereby keeping the goal face in a vertical position. The ground support bar can be a number of shapes, including a U- or V-shape, depending on the sport that is desired to be played or practiced.

It should be appreciated that the sports goal may be provided as a kit, for example, disposed in a bag in a disassembled form for transport and later reassembly at a desired location for end use as the sports goal.

In a further embodiment, the elastic cord runs throughout the structure continuously. The ends of the cord are connected together to create a continuous cord/cable loop, which reinforces one continuous sports goal frame. It should be appreciated that the continuous loop may be doubled or more in particular segments of the goal frame, depending on the configuration. The compressive force of the elastic cord/cable then acts to hold the sports goal together when erected, and to keep the various segments loosely connected when the sports goal is diassembled. The elastic cord thereby applies a compressive force against the connected frame members, resisting the unintentional disassembly thereof when assembled.

In yet another embodiment, the elastic cord is not continuous, but is provided in sections with each section internally attached to two separable support segments. The cord traverses the junction between the two separable support segments, resulting in multiple stretched cords/cables that are then used to maintain one continuous sports goal frame. The compressive force of the elastic cord/cable then acts to hold the sports goal together when erected or when folded. The elastic cord thereby applies a compressive force against the connected frame members, resisting the unintentional disassembly thereof.

In an additional embodiment, the net can be permanently connected to the goal support structure. The net is of a dimension to adequately cover the supporting structure. The bottom of the net attaches to the ground support bar, the top of the net attaches to the top crossbar and the sides of the net attach to the sidebars. The net can remain attached to the frame, which allows the goal to be used or stored as a single unit.

In exemplary embodiments, a foldable, portable sports goal structure where the goal frame is hollow and contains elastic cord or cable whose compressive forces hold the frame together, is provided. The sports goal is made up of ground support bars, sidebars and a crossbar and where support bars may or may not be present. An elastic cord or cable that is under tensions is used to hold the frame together when the goal is set up. The elastic cord or cable also holds the frame together when the goal is folded up so the goal can be quickly set up or folded up. The net can remain attached to the frame, which allows the goal to be used or stored as a single unit.

This sports goal structure is used with a net to construct a sports goal for use in various sporting events. The goal would be comprised of two sidebars of specified length which support a top crossbar of specified length. The two sidebars along with the top crossbar represent the goal face or goal opening. The size of the sidebars and the crossbar determine the dimensions of the goal opening. A U-shaped frame in the case of a soccer goal or hockey goal or a V-shaped frame in the case of a lacrosse goal that connects to the sidebars and lies on the ground would be used to support the goal face (keeping the goal face is in a vertical position). The U-shaped or V-shaped ground frame is also used to support the bottom of the net. The top of the net would be connected to the top crossbar and the sides of the net would be connected on each side of the goal face to the sidebars. The sports goal is ready for use when the frame is erected and a net is connected.

The frame of the sports goal would be comprised of wood, plastic or metal with a hollow core. An elastic cord or cable would be stretched and threaded throughout the entire structure of the sports goal or the elastic cord or cable (would be stretched across every junction and connected on either side of the junction. In the case where the cord/cable is threaded throughout the entire frame, the ends are connected together to create continuous cord/cable loops which creates one continuous sports goal frame. Alternatively, the elastic cords/cables could be stretched and connected to the frame on each side of each junction so as to make up multiple stretched cords/cables that are then used to maintain one continuous sports goal frame. The compressive force of the elastic cord/cable then acts to hold the sports goal together when erected or when folded. With either construction, the compressive force of the elastic cord/cable would hold the frame together during use. The frame with a hollow core along with the elastic cord/cable comprise the sports goal of this invention.

Another advantage of this construction is that the net can be permanently connected to the goal creating one unit. As a single unit (frame and net), the sports goal can be folded or unfolded quickly and easily. The net could be connected to the frame and stay in place when in storage, transport or during use. Having the entire sports goal and net connected allows for quick and easy fold up or unfold. Once erected, the sports goal can be easily moved into position and is ready for use.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION

The following detailed description and appended drawings describe and illustrate various embodiments of the collapsible sports goal. The description and drawings serve to enable one skilled in the art to make and use the collapsible sports goal, and are not intended to limit the scope of the collapsible sports goal in any manner. In respect of the methods disclosed, the steps presented are exemplary in nature, and thus, the order of the steps is not necessary or critical unless otherwise disclosed.

Figure 1:
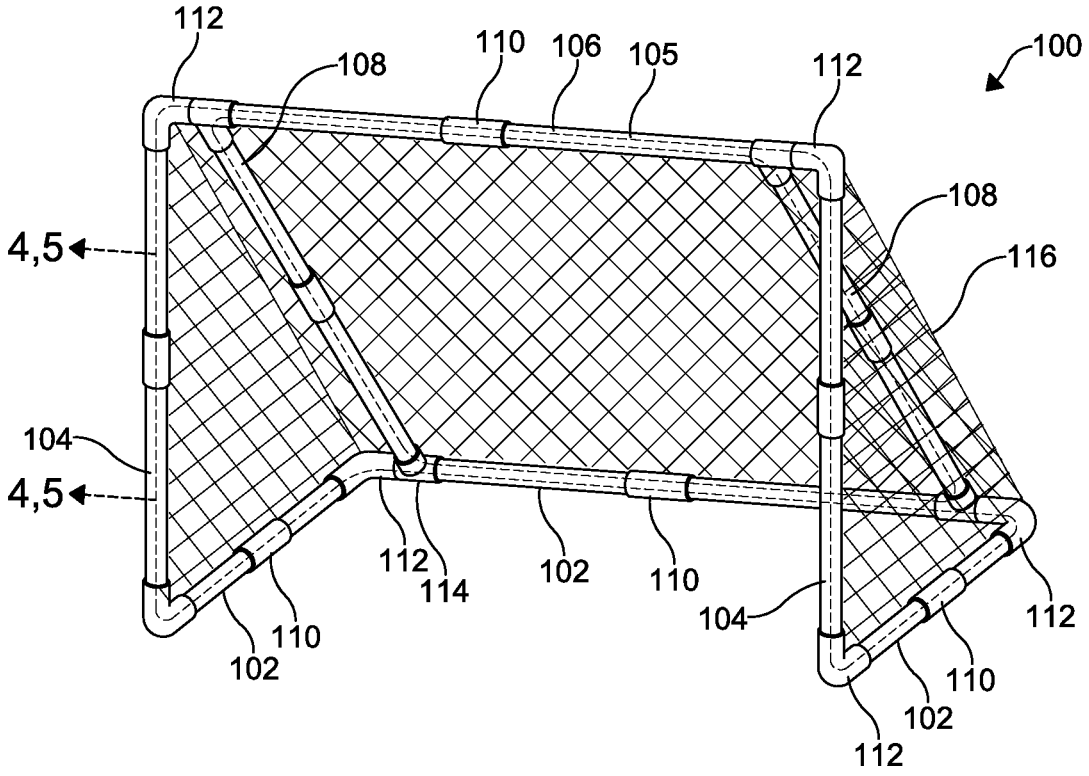
FIG. 1 is a front perspective view of a fully assembled goal with side support bars, according to one embodiment of the disclosure, with an interior elastic cord identified by dashed lines.
Figure 2:
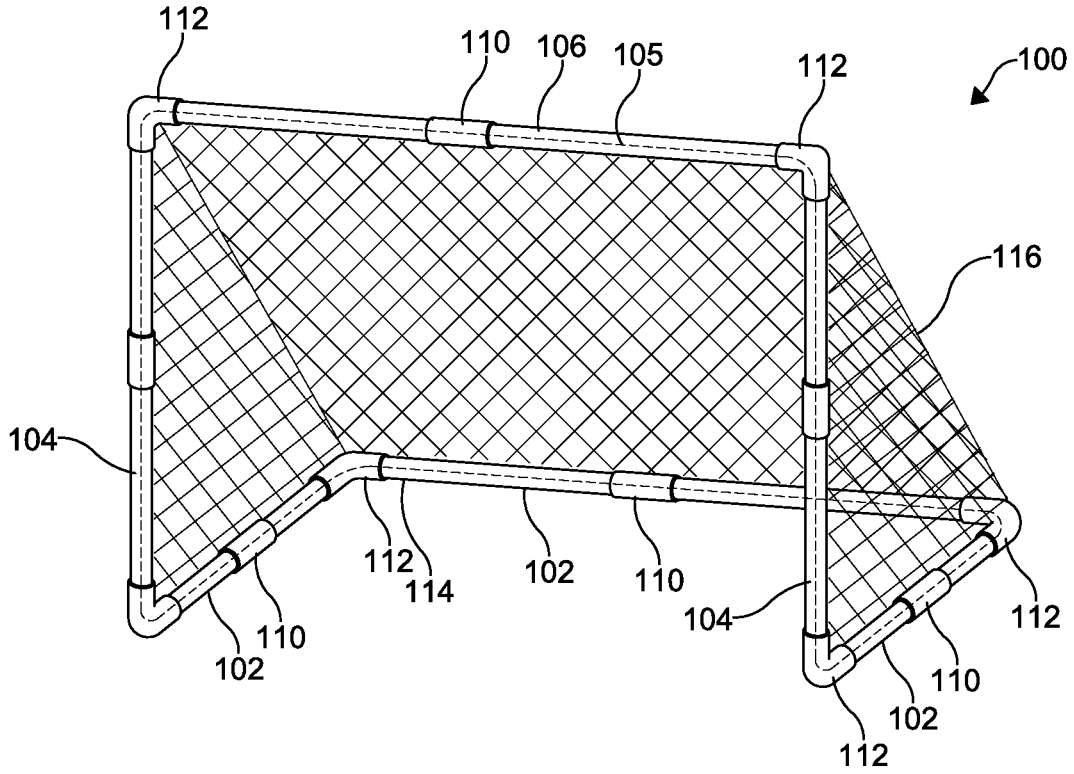
FIG. 2 is a front perspective view of a fully assembled goal without side support bars, according to another embodiment of the disclosure, with an interior elastic cord identified by dashed lines.

FIGS. 1-2 show a collapsible sports goal 100 that is easily assembled using a series of hollow support bars 102, 104, 106, 108 connected by an elastic cord 105. These support bars 102, 104, 106, 108 can be made of wood, metal, plastic or any other suitable material, as desired.

The support bars 102, 104, 106, 108 are formed from a plurality of individual segments that are selectively connected to one another using friction fit couplers 110, 112, 114. For example, the couplers 110, 112, 114 may have an inner diameter substantially the same as an outer diameter of the support bars 102, 104, 106, 108 with which they connect. These couplers 110, 112, 114 can be straight line couplers 110, elbow couplers 112, and T-shaped couplers 114, as non-limiting examples. Other shapes for the couplers 110, 112, 114 may also be employed to impart a desired shape to the collapsible sports goal 100 upon assembly, within the scope of the present disclosure.

Although the couplers 110, 112, 114 are shown herein as being formed separately from each of the support segments 102, 104, 106 108, it should be appreciated that in other embodiments each of the couplers 110, 112, 114 may be formed integrally with one of the support segments 102, 104, 106 108. In such an embodiment, the coupler 110, 112, 114 may be an end of one of the support segments 102, 104, 106 108 that has a diameter greater than or less than an adjacent one of the support segments 102, 104, 106, 108 in the series. The end would be configured to either receive or be inserted into the adjacent hollow support segments 102, 104, 106, 108, and to have a friction fit with the same. In this manner, the end of one of the support segments 102, 104, 106 108 will function as the coupler 110, 112, 114, even though it is integrally formed as a one-piece unitary structure with the corresponding support segment 102, 104, 106 108.

The support bars 102, 104, 106, 108 are arranged to form a ground support bar 102, which stabilizes spaced apart sidebars 104 that support a crossbar 106. The ground support bar 102 of the goal 100 is illustrated in the drawings as being substantially U-shaped, but can be one of a multitude of shapes, including V-shaped, as desired.

In the embodiment shown in FIG. 1, the goal 100 may also have rear supports 108. The rear supports 108 may connect a rear-ward portion of the ground support bar 102 to the crossbar 106. FIG. 2 illustrates another embodiment, having the goal 100 without the rear supports 108. A skilled artisan may also select other suitable configurations for the goal 100 within the scope of the present disclosure.

More specifically, FIG. 1 illustrates the fully assembled goal 100 with side support bars segments 104 connected to the ground support bar segments 102 with the elbow couplers 112, and the ground support segments 102 connected to the crossbar segments 106 via the rear supports 108, using the T-shaped couplers 116. In particular, the ground support bar 102 may be composed of six segments, with certain segments connected using the straight coupler 110, and other segments connected with the elbow 112 in order to form the substantially U-shaped ground support bar 102.

FIG. 1 further illustrates that the ground support bar segments 102 are connected to the sidebar segments 104 by the elbow couplers 112. The crossbar segments 106 are connected to each other using the straight coupler 110, and are connected to the sidebar segments 104 also using elbow coupler 112. The sidebars 104 may also have segments connected with the straight coupler 110.

With reference to FIG. 2, the goal 100 according to another embodiment is shown. The goal 100 of FIG. 2 only uses the ground support bar 102 to stabilize the goal opening. The ground support bar 102 is composed of six segments that are connected using the straight couplers 110 and the elbow couplers 112. The ground support bar segments 102 are connected to the sidebar segments 104 by the elbow couplers 112. The crossbar segments 106 are connected to each other using the straight coupler 110, and are connected to the sidebar segments 104 using the elbow couplers 112.

As shown in FIGS. 1 and 2, the support bars 102, 104, 106, 108 also have a net 116 connected thereto. The net 116 may be removably or irremovably affixed to the support bars 102, 104, 106, 108, as desired. For example, the net 116 may be connected with hooks, clips, or the like. A particular advantage of the collapsible goal 100 is that the net 116 can be permanently attached to the goal 100 creating one unit. As a single unit (i.e., frame and net), the sports goal 100 can be disassembled and folded quickly and easily for storage and transport, while militating against a loss of individual pieces due to the use of the elastic cord 105.

In particular, it should be understood that the elastic cord 105 connects the individual segments of the support bars 102, 104, 106, 108. The elastic cord 105 can either run throughout the structure continuously (FIG. 4), or be internally attached to individual segments (FIG. 5). Where the elastic cord 105 is continuous, it should be appreciated that it may run through individual segments more than once, depending on the overall construction of the goal 100. In either embodiment, the cord 105 traverses the junction between the couplers 110, 112, 114 and support bars 102, 104, 106, 108, keeping them connected at all times.

The elastic cord 105 has a pretension imparted thereto, and is configured to retain a tension even when the goal 100 is fully assembled. The elastic cord 105 not only keeps all of the couplers 110, 112, 114 and support bars 102, 104, 106, 108 together in proper orientation for assembly, but also applies a compressive force against the connected support bars 102, 104, 106, 108 and the couplers 110, 112, 114 when assembled, thereby providing a desired rigidity to the goal 100 and militating against an unintentional disassembly.

Figure 3:
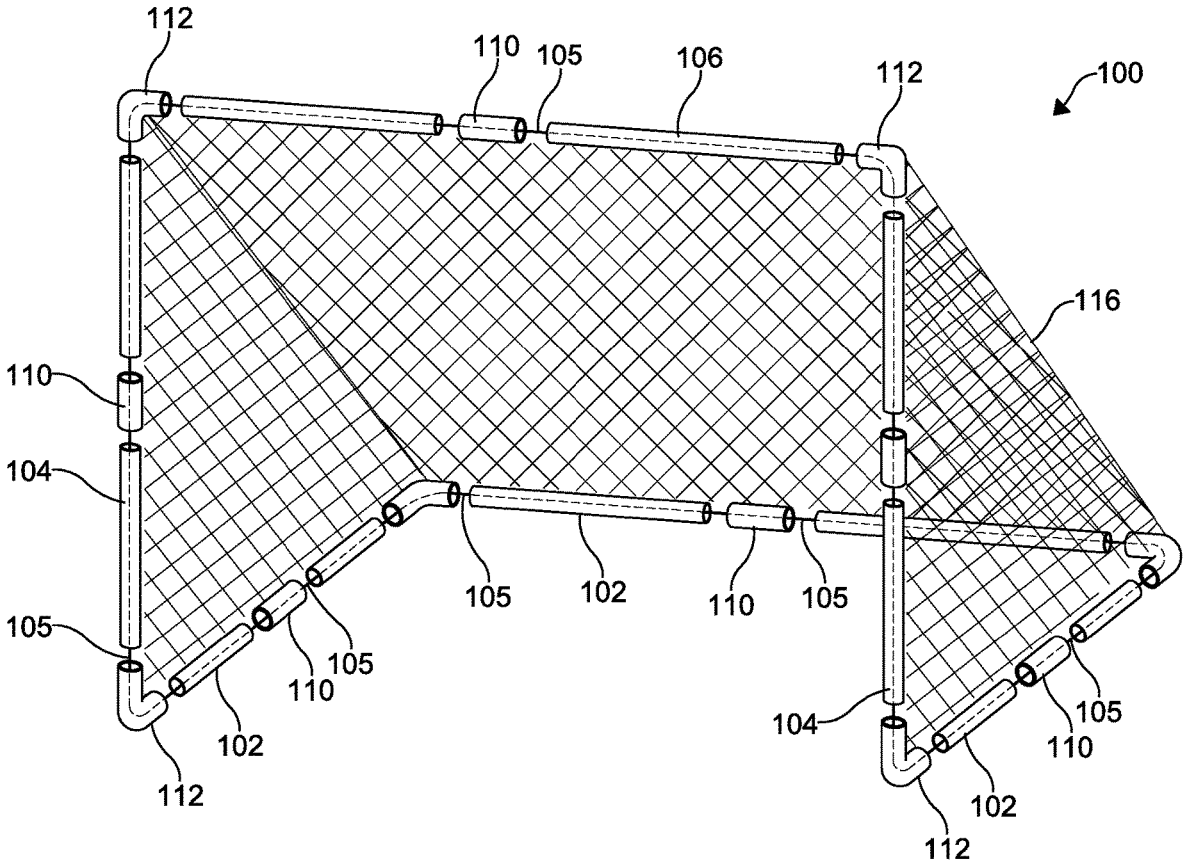
FIG. 3 is an exploded front perspective view of the goal shown in FIG. 2, illustrating that the goal can be broken down for storage and transport, and further depicted without a net attached thereto for purpose of clarity.

FIG. 3 is a representation of the dissembled support bars 102, 104, 106, 108, showing that the cord 105 may be exposed upon disassembly of the goal 100. Where the cord 105 is exposed, it should be appreciated that this represents a location where the goal 100 will fold upon disassembly. In this manner, the support bars 102, 104, 106, 108 are held together with the elastic cord/cable 105, even when not rigidly coupled with the couplers 110, 112, 114. This allows the goal to be easily disassembled for transport or storage.

Figure 4:
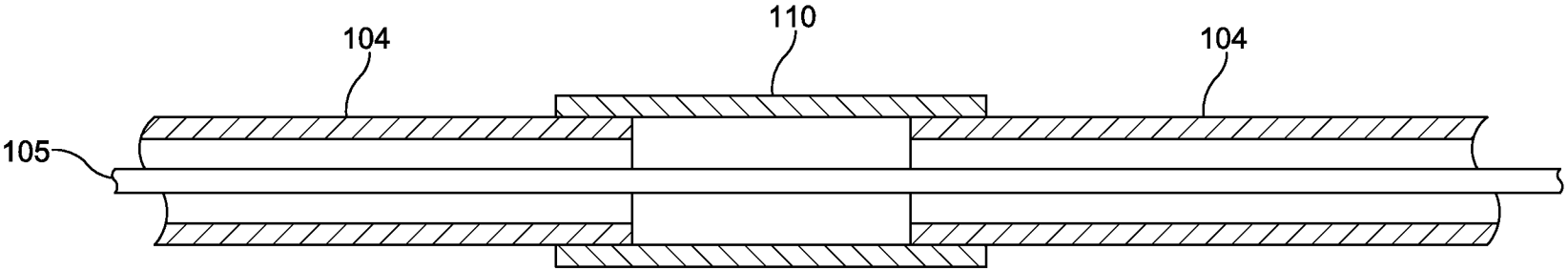
FIG. 4 is a fragmentary, cross-sectional side elevational view of two support segments of the goal taken along section line 4,5—4,5 in FIG. 1, according to one embodiment of the disclosure, the support segments connected via a coupler, and a continuous elastic cord running through both supports and providing a tension to hold the supports in the coupler.
Figure 5:
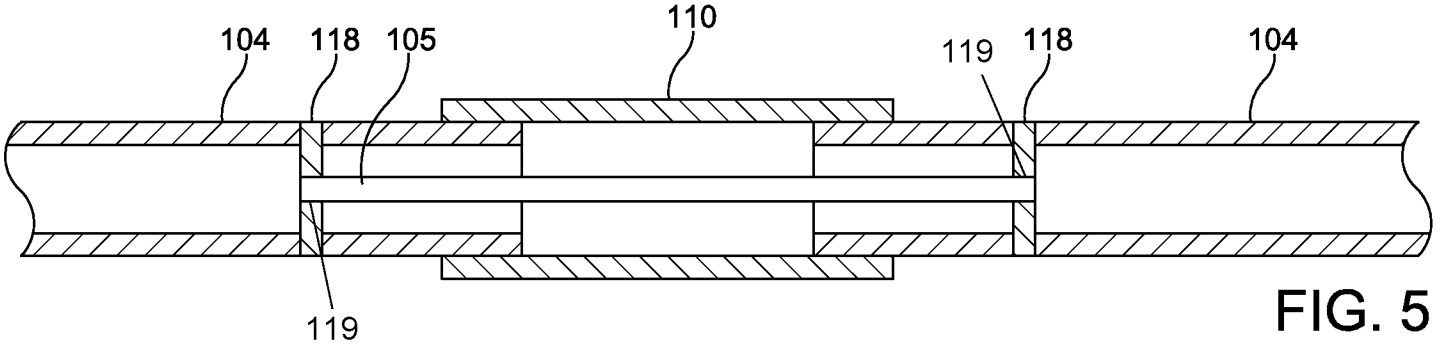
FIG. 5 is a fragmentary, cross-sectional side elevational view of two support segments of the goal taken along section line 4,5—4,5 in FIG. 1, according to another embodiment of the disclosure, the support segments connected via a coupler, and an individual elastic cord segment attached to each support.

FIG. 4 is an enlarged cross-sectional view of a coupling connection in the frame of the goal 100, in which the continuous elastic cord 105 is employed. The elastic cord/cable 105 extends continuously from one segment 104 through the straight coupler 110 into the other segment 104 of the sidebar 104, and likewise throughout the other segments and couplers of the entire frame. The compressive force of the stretched elastic cord/cable 105 facilitates the holding together of the frame upon assembly.

FIG. 5 is an enlarged cross-sectional view of a coupling connection in the frame of the goal 100, according to another embodiment of the present disclosure. In this embodiment, the elastic cord/cable 105 extends through the coupler 110, but is not continuous throughout the entire frame. Instead, individual sections of the elastic cord/cable 105 span the gap between the ends of the segments 104, and are affixed to the ends of the segments 104 by fasteners 118 on each side of the joint.

The fasteners 118 may be, in particular embodiments, one of a bolt, a screw, a pin, and a rod disposed through the segments 104 in an orientation transverse that of the cord 105. The cord 105 may be tied or knotted around the fasteners 118, for example. Alternatively, the ends of the cord 105 may have stop features that abut an eyelet 119 formed in the each of the fastener 118. In any case, the compressive force of the stretched elastic cord/cable 105 holds the joint together when the frame is assembled.

With renewed reference to FIGS. 1-2, and where the net 116 is not permanently affixed to the segments of the frame, the net 116 having specific dimensions to match the frame may be attached once the frame has been assembled. The net 116 can be attached to the frame using a variety of methods, such as straps or hook-and-loop fasteners. The ground support bar 102 would attach to the bottom of the net 116. The top of the net 116 would be connected to the crossbar 106 and the sides of the net 116 would be connected to each sidebar 104.

As a single unit frame and net 116, the sports goal 100 can be folded or unfolded quickly and easily. The net 116 could be connected to the frame and stay in place when in storage, transport or during use. Having the entire support frame and net 116 connected allows for quick and easy assembly and disassembly. The goal 100 is thereby made ready for use in a variety of sports such as, soccer, hockey, lacrosse, or as a practice net for kicking a football or for hitting golf balls, as non-limiting examples.

Advantageously, a portable framework structure in the form of the sports goal 100 described hereinabove may be used in combination with a net for use in various sporting events. In operation, the sports goal 100 is easily disassembled or broken down for storage and transport, for example, in a bag to move to the desired location, and also easily reassembled for use.

Other variations and embodiments of the present collapsible sports goal are contemplated. Those skilled in the art will readily appreciate such variations upon carefully reviewing the above disclosure. Therefore, the present collapsible sports goal is not to be limited by the above description, but is to be determined in the scope of the claims, which follow.

What is claimed is:

1. A portable sports goal kit, consisting of:

a selectively interconnecting frame that is collapsed in a disassembled state for storage or transport and which is configured to be assembled into an assembled state for use as a sports goal, the selectively interconnecting frame further consisting of a plurality of hollow and separable support segments, each of the support segments having a cylindrical inner surface, and a cylindrical outer surface having an outer diameter that is consistent along a length of each of the support segments extending from a first end of the support segment to a second end of the support segment, a plurality of hollow couplers including straight couplers and elbow couplers, each of the hollow couplers separated from the support segments, each of the straight couplers having a cylindrical inner surface, and a cylindrical outer surface with an outer diameter that is consistent along a length of each of the straight couplers extending from a first end of the straight coupler to a second end of the straight coupler, wherein, upon assembly into the assembled state for use as a sports goal, one of the straight couplers is disposed between every adjacent two of the elbow couplers and connects two of the support segments between the two of the elbow couplers, and each of the couplers having an inner diameter that is the same as the outer diameter of the support segments, and each of the couplers configured to removably receive with a friction fit two of the support segments and together with the support segments configured to form the selectively interconnecting frame in the assembled state, and each of the couplers further having the outer diameter that is greater than the outer diameter of the support segments, and a plurality of separate and elastic cords, one of the cords disposed in each of the support segments and the couplers, the cords holding the separable support segments and the couplers together, wherein each of the cords is directly connected to two of the support segments with mechanical fasteners that are disposed in the support segments, each of the cords also disposed through an entirety of one of the couplers and only a portion of the two of the support segments to which the cord is connected, wherein each of the mechanical fasteners is one of a bolt, a screw, a pin, and a rod, each of the mechanical fasteners having a first end and a second end with an eyelet formed therethrough and disposed equidistant to each of the first end and the second end of the mechanical fastener, wherein each of the cords is disposed through the eyelet of the mechanical fastener disposed in the support segment adjacent a first end of the coupler and the eyelet of the mechanical fastener disposed in the support segment adjacent a second end of the coupler, and each of the mechanical fasteners spans a hollow portion of the support segment within which the mechanical fastener is disposed, the mechanical fasteners holding the cords at a central position spaced apart evenly from inner walls of each of the support segments to which the mechanical fasteners are attached, and each of the mechanical fasteners is oriented transverse with an orientation of the one of the cords to which the mechanical fastener is connected, and each of the mechanical fasteners is only directly connected to a single one of the cords; and a net permanently attached to all of the plurality of hollow and separable support segments, wherein the net remains attached to all of the support segments in both the assembled state and the disassembled state;

wherein the plurality of separate and elastic cords holds together all of the support segments and all of the couplers where the selectively interconnecting frame is collapsed in the disassembled state; and wherein the plurality of separate and elastic cords is configured to be under tension where all of the separable support segments and the couplers are assembled as the interconnecting frame connected in the assembled state.

2. The portable sports goal kit of claim 1, wherein the support segments form a ground support bar, a pair of sidebars, and a crossbar in the assembled state.

3. The portable sports goal of claim 1, wherein the ground support bar is U-shaped in the assembled state.

* * * * *